US011448430B2

(12) United States Patent
Taras et al.

(10) Patent No.: US 11,448,430 B2
(45) **Date of Patent: *Sep. 20, 2022**

(54) HEAT PUMP AND WATER HEATER

(71) Applicant: Climate Master, Inc., Oklahoma City, OK (US)

(72) Inventors: Michael F. Taras, Oklahoma City, OK (US); Michael S. Privett, Tuttle, OK (US); Jeremy R. Smith, Edmond, OK (US)

(73) Assignee: Climate Master, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,558

(22) Filed: Dec. 21, 2020

(65) Prior Publication Data

US 2021/0131709 A1 May 6, 2021

Related U.S. Application Data

(63) Continuation of application No. 15/634,434, filed on Jun. 27, 2017, now Pat. No. 10,871,314.

(Continued)

(51) Int. Cl.
*F25B 30/02* (2006.01)
*F25B 13/00* (2006.01)

(Continued)

(52) U.S. Cl.
CPC ..... *F25B 6/04* (2013.01); *F25B 13/00* (2013.01); *F25B 30/02* (2013.01); *F25B 41/20* (2021.01);

(Continued)

(58) Field of Classification Search
CPC .. F25B 30/02; F25B 6/04; F25B 13/00; F25B 2339/047; F25B 2400/0403; F25B 2400/0409; F25B 2600/2501
See application file for complete search history.

(56) References Cited

U.S. PATENT DOCUMENTS 3,460,353 A 8/1969 Ogata et al.
3,916,638 A 11/1975 Schmidt (Continued)

FOREIGN PATENT DOCUMENTS

CA 1178268 11/1984
CN 1987397 A 6/2007

(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).

(Continued)

*Primary Examiner* — Lionel Nouketcha
(74) *Attorney, Agent, or Firm* — Neal, Gerber & Eisenberg LLP; Thomas E. Williams

(57) ABSTRACT

An embodiment of the instant disclosure comprises a reversible heat pump and water heating system for conditioning a space and heating water. The system comprises a refrigerant circuit that includes a compressor, a source heat exchanger, a space heat exchanger, and an expansion device. A 4-way reversing valve alternates between heating and cooling modes of operation. The system includes a heat exchanger for heating water in the water heating loop, and a 3-way valve that either actuates the refrigerant flow through the water heater heat exchanger or bypasses at least a portion of the refrigerant flow around the water heater heat exchanger. The heat pump system is operable in at least five modes—space heating only, space cooling only, water heating only, and either space heating or space cooling combined with water heating. Use of a modulating 3-way valve allows the amount of the refrigerant flow through the water heating (Continued)

heat exchanger to be adjusted to precisely match space conditioning and water heating demands and stable operation of the heat pump system. Either of the space and source heat exchangers may be bypassed and deactivated to reduce the heat pump system power consumption.

15 Claims, 7 Drawing Sheets

Related U.S. Application Data

(60) Provisional application No. 62/359,798, filed on Jul. 8, 2016.

(51) Int. Cl.
*F25B 6/04* (2006.01)
*F25B 41/20* (2021.01)

(52) U.S. Cl.
CPC ..... *F25B 2313/0233* (2013.01); *F25B 2313/02321* (2013.01); *F25B 2339/047* (2013.01); *F25B 2400/0403* (2013.01); *F25B 2600/2501* (2013.01)

(56) References Cited

U.S. PATENT DOCUMENTS 3,938,352 A 2/1976 Schmidt
4,072,187 A 2/1978 Lodge
4,173,865 A 11/1979 Sawyer
4,179,894 A 12/1979 Hughes
4,299,098 A 11/1981 Derosier
4,399,664 A 8/1983 Derosier
4,441,901 A 4/1984 Endoh
4,493,193 A 1/1985 Fisher
4,528,822 A 7/1985 Glamm
4,538,418 A 9/1985 Lawrence et al.
4,575,001 A 3/1986 Oskarsson et al.
4,592,206 A 6/1986 Yamazaki et al.
4,598,557 A 7/1986 Robinson et al.
4,645,908 A 2/1987 Jones
4,646,538 A 3/1987 Blackshaw et al.
4,685,307 A 8/1987 Jones
4,693,089 A 9/1987 Bourne et al.
4,698,978 A 10/1987 Jones
4,727,727 A 3/1988 Reedy
4,766,734 A 8/1988 Dudley
4,776,180 A 10/1988 Patton et al.
4,796,437 A 1/1989 James
4,798,059 A 1/1989 Morita
4,799,363 A 1/1989 Nakamura
4,835,976 A 6/1989 Torrence
4,856,578 A 8/1989 McCahill
4,893,476 A 1/1990 Bos et al.
4,909,041 A 3/1990 Jones
4,920,757 A 5/1990 Gazes et al.
4,924,681 A 5/1990 De Vit et al.
4,938,032 A 7/1990 Mudford
5,038,580 A 8/1991 Hart
5,044,425 A 9/1991 Tatsumi et al.
5,081,848 A 1/1992 Rawlings et al.
5,088,296 A 2/1992 Hamaoka
5,099,651 A 3/1992 Fischer
5,105,629 A 4/1992 Parris et al.
5,136,855 A 8/1992 Lenarduzzi
5,172,564 A 12/1992 Reedy
5,187,944 A 2/1993 Jarosch
5,224,357 A 7/1993 Galiyano et al.
5,269,153 A 12/1993 Cawley
5,305,822 A 4/1994 Kogetsu et al.
5,309,732 A 5/1994 Sami
5,323,844 A 6/1994 Sumitani et al.
5,339,890 A 8/1994 Rawlings
5,355,688 A 10/1994 Rafalovich et al.
5,372,016 A 12/1994 Rawlings
5,438,846 A 8/1995 Datta
5,461,876 A 10/1995 Dressier
5,465,588 A 11/1995 McCahill et al.
5,477,914 A 12/1995 Rawlings
5,497,629 A 3/1996 Rafalovich et al.
5,507,337 A 4/1996 Rafalovich et al.
5,533,355 A 7/1996 Rawlings
5,564,282 A 10/1996 Kaye
5,613,372 A 3/1997 Beal et al.
5,619,864 A 4/1997 Reedy
5,628,200 A 5/1997 Pendergrass
5,651,265 A 7/1997 Grenier
5,669,224 A 9/1997 Lenarduzzi
5,689,966 A 11/1997 Zess et al.
5,729,985 A 3/1998 Yoshihara et al.
5,758,514 A 6/1998 Genung et al.
5,802,864 A 9/1998 Yarbrough et al.
5,927,088 A 7/1999 Shaw
6,032,472 A 3/2000 Heinrichs et al.
6,070,423 A 6/2000 Hebert
6,082,125 A 7/2000 Savtchenko
6,123,147 A 9/2000 Pittman
6,149,066 A 11/2000 Perry et al.
6,167,715 B1 1/2001 Hebert
6,212,892 B1 4/2001 Rafalovich
6,227,003 B1 5/2001 Smolinsky
6,253,564 B1 7/2001 Yarbrough et al.
6,347,527 B1 2/2002 Bailey et al.
6,385,983 B1 5/2002 Sakki et al.
6,418,745 B1 7/2002 Ratliff
6,434,960 B1 8/2002 Rousseau
6,474,087 B1 11/2002 Lifson
6,536,221 B2 3/2003 James
6,655,164 B2 12/2003 Rogstam
6,662,864 B2 12/2003 Burk et al.
6,668,572 B1 12/2003 Seo et al.
6,694,750 B1 2/2004 Lifson et al.
6,729,151 B1 5/2004 Thompson
6,751,972 B1 6/2004 Jungwirth
6,804,975 B2 10/2004 Park
6,817,205 B1 11/2004 Lifson et al.
6,826,921 B1 12/2004 Uselton
6,857,285 B2 2/2005 Hebert
6,892,553 B1 5/2005 Lifson et al.
6,915,656 B2 7/2005 Ratliff
6,931,879 B1 8/2005 Wiggs
6,938,438 B2 9/2005 Lifson et al.
6,941,770 B1 9/2005 Taras et al.
7,000,423 B2 2/2006 Lifson et al.
7,059,151 B2 6/2006 Taras et al.
7,114,349 B2 10/2006 Lifson et al.
7,150,160 B2 12/2006 Herbert
7,155,922 B2 1/2007 Harmon et al.
7,185,505 B2 3/2007 Kamimura
RE39,597 E 5/2007 Rousseau
7,210,303 B2 5/2007 Zhang et al.
7,228,707 B2 6/2007 Lifson et al.
7,234,311 B2 6/2007 Lifson et al.
7,254,955 B2 8/2007 Otake et al.
7,263,848 B2 9/2007 Bhatti
7,272,948 B2 9/2007 Taras et al.
7,275,385 B2 10/2007 Abel et al.
7,325,414 B2 2/2008 Taras et al.
7,454,919 B2 11/2008 Ookoshi et al.
7,484,374 B2 2/2009 Pham et al.
7,617,697 B2 11/2009 McCaughan
7,654,104 B2 2/2010 Groll et al.
7,716,943 B2 5/2010 Seefeldt
7,770,405 B1 8/2010 Dillon
7,823,404 B2 11/2010 Hanson
7,845,190 B2 12/2010 Pearson
7,854,137 B2 12/2010 Lifson et al.
7,856,834 B2 12/2010 Haley
7,913,501 B2 3/2011 Ellis et al.
7,937,960 B2 5/2011 Matsui
7,958,737 B2 6/2011 Lifson et al.
7,975,495 B2 7/2011 Voorhis et al.
7,975,506 B2 7/2011 James et al.

(56) References Cited

U.S. PATENT DOCUMENTS

| | | | |
|---|---|---|---|
| 7,997,092 | B2 | 8/2011 | Lifson et al. |
| 8,037,713 | B2 | 10/2011 | Haley et al. |
| 8,074,459 | B2 | 12/2011 | Murakami et al. |
| 8,079,228 | B2 | 12/2011 | Lifson et al. |
| 8,079,229 | B2 | 12/2011 | Lifson et al. |
| 8,082,751 | B2 | 12/2011 | Wiggs |
| 8,136,364 | B2 | 3/2012 | Lifson et al. |
| 8,191,376 | B2 | 6/2012 | Fox et al. |
| 8,220,531 | B2 | 7/2012 | Murakami et al. |
| 8,286,438 | B2 | 10/2012 | McCahill |
| 8,418,482 | B2 | 4/2013 | Bush et al. |
| 8,418,486 | B2 | 4/2013 | Taras et al. |
| 8,424,326 | B2 | 4/2013 | Mitra et al. |
| 8,459,052 | B2 | 6/2013 | Bush et al. |
| 8,528,359 | B2 | 9/2013 | Lifson et al. |
| 8,561,425 | B2 | 10/2013 | Mitra et al. |
| 8,650,893 | B2 | 2/2014 | Hanson |
| 8,733,429 | B2 | 5/2014 | Harrison et al. |
| 8,756,943 | B2 | 6/2014 | Chen et al. |
| 8,769,982 | B2 | 7/2014 | Ignatiev et al. |
| 8,984,903 | B2 | 3/2015 | Itoh et al. |
| 9,052,125 | B1 | 6/2015 | Dostal |
| 9,562,700 | B2 | 2/2017 | Watanabe |
| 10,072,856 | B1 | 9/2018 | Akin et al. |
| 10,118,462 | B2 | 11/2018 | Kohigashi et al. |
| 10,119,738 | B2 | 11/2018 | Hammond et al. |
| 10,345,004 | B1 | 7/2019 | Hern et al. |
| 10,753,661 | B2 | 8/2020 | Hammond et al. |
| 10,866,002 | B2 | 12/2020 | Taras et al. |
| 10,871,314 | B2 | 12/2020 | Taras et al. |
| 10,935,260 | B2 | 3/2021 | Taras et al. |
| 2003/0061822 | A1 | 4/2003 | Rafalovich |
| 2003/0221436 | A1 | 12/2003 | Xu |
| 2003/0221445 | A1 | 12/2003 | Smolinsky |
| 2006/0010908 | A1 | 1/2006 | Taras et al. |
| 2006/0218949 | A1 | 10/2006 | Ellis et al. |
| 2006/0225445 | A1 | 10/2006 | Lifson et al. |
| 2007/0074536 | A1 | 4/2007 | Bai |
| 2007/0289319 | A1 | 12/2007 | Kim et al. |
| 2007/0295477 | A1 | 12/2007 | Mueller et al. |
| 2008/0016895 | A1 | 1/2008 | Kim et al. |
| 2008/0041072 | A1 | 2/2008 | Seefeldt |
| 2008/0173034 | A1 | 7/2008 | Shaw |
| 2008/0196418 | A1 | 8/2008 | Lifson et al. |
| 2008/0197206 | A1 | 8/2008 | Murakami et al. |
| 2008/0209930 | A1 | 9/2008 | Taras et al. |
| 2008/0256975 | A1 | 10/2008 | Lifson et al. |
| 2008/0282718 | A1 | 11/2008 | Beagle |
| 2008/0296396 | A1 | 12/2008 | Corroy et al. |
| 2008/0302113 | A1 | 12/2008 | Yin et al. |
| 2008/0302118 | A1 | 12/2008 | Chen et al. |
| 2008/0302129 | A1 | 12/2008 | Mosemann et al. |
| 2008/0307813 | A1 | 12/2008 | Lifson et al. |
| 2009/0000611 | A1 | 1/2009 | Kaiser |
| 2009/0107656 | A1 | 4/2009 | Marois |
| 2009/0208331 | A1 | 8/2009 | Haley et al. |
| 2009/0294097 | A1 | 12/2009 | Rini et al. |
| 2009/0314014 | A1 | 12/2009 | Ericsson |
| 2010/0005821 | A1 | 1/2010 | McCahill |
| 2010/0005831 | A1 | 1/2010 | Vaisman et al. |
| 2010/0024470 | A1 | 2/2010 | Lifson et al. |
| 2010/0058781 | A1 | 3/2010 | Lifson et al. |
| 2010/0064710 | A1 | 3/2010 | Slaughter |
| 2010/0064722 | A1 | 3/2010 | Taras |
| 2010/0077788 | A1 | 4/2010 | Lewis |
| 2010/0114384 | A1 | 5/2010 | Maxwell |
| 2010/0132399 | A1 | 6/2010 | Mitra et al. |
| 2010/0199715 | A1 | 8/2010 | Lifson et al. |
| 2010/0251750 | A1 | 10/2010 | Lifson et al. |
| 2010/0281894 | A1 | 11/2010 | Huff |
| 2010/0287969 | A1 | 11/2010 | Ueda et al. |
| 2010/0326100 | A1 | 12/2010 | Taras et al. |
| 2011/0023515 | A1 | 2/2011 | Kopko et al. |
| 2011/0036119 | A1 | 2/2011 | Fujimoto et al. |
| 2011/0041523 | A1 | 2/2011 | Taras et al. |
| 2011/0061413 | A1 | 3/2011 | Setoguchi |
| 2011/0079032 | A1 | 4/2011 | Taras et al. |
| 2011/0088426 | A1 | 4/2011 | Lochtefeld |
| 2011/0094248 | A1 | 4/2011 | Taras et al. |
| 2011/0094259 | A1 | 4/2011 | Lifson et al. |
| 2011/0132007 | A1 | 6/2011 | Weyna et al. |
| 2011/0174014 | A1 | 7/2011 | Scarcella et al. |
| 2011/0203299 | A1 | 8/2011 | Jing et al. |
| 2011/0209490 | A1 | 9/2011 | Mijanovic et al. |
| 2011/0259025 | A1 | 10/2011 | Noh et al. |
| 2011/0289950 | A1 | 12/2011 | Kim et al. |
| 2011/0289952 | A1 | 12/2011 | Kim et al. |
| 2012/0011866 | A1 | 1/2012 | Scarcella et al. |
| 2012/0067965 | A1 | 3/2012 | Rajasekaran et al. |
| 2012/0103005 | A1 | 5/2012 | Kopko et al. |
| 2012/0198867 | A1 | 8/2012 | Ng et al. |
| 2012/0205077 | A1 | 8/2012 | Zinger et al. |
| 2012/0247134 | A1 | 10/2012 | Gurin |
| 2012/0291460 | A1 | 11/2012 | Aoyagi |
| 2013/0014451 | A1 | 1/2013 | Russell et al. |
| 2013/0031934 | A1 | 2/2013 | Huff et al. |
| 2013/0098085 | A1 | 4/2013 | Judge et al. |
| 2013/0104574 | A1 | 5/2013 | Dempsey et al. |
| 2013/0180266 | A1 | 7/2013 | Bois |
| 2013/0269378 | A1 | 10/2013 | Wong |
| 2013/0305756 | A1 | 11/2013 | Gomes et al. |
| 2014/0013782 | A1 | 1/2014 | Kopko et al. |
| 2014/0013788 | A1 | 1/2014 | Kopko et al. |
| 2014/0033753 | A1 | 2/2014 | Lu et al. |
| 2014/0033755 | A1 | 2/2014 | Wong |
| 2014/0053585 | A1 | 2/2014 | Huff |
| 2014/0060101 | A1 | 3/2014 | Styles et al. |
| 2014/0123689 | A1 | 5/2014 | Ellis et al. |
| 2014/0245770 | A1 | 9/2014 | Chen et al. |
| 2014/0260392 | A1 | 9/2014 | Hawkins et al. |
| 2015/0052937 | A1 | 2/2015 | Hung |
| 2015/0059373 | A1 | 3/2015 | Maiello et al. |
| 2015/0204586 | A1 | 7/2015 | Burg et al. |
| 2015/0285539 | A1 | 10/2015 | Kopko |
| 2017/0010029 | A9 | 1/2017 | Reytblat et al. |
| 2017/0227250 | A1 | 8/2017 | Karamanos |
| 2018/0010829 | A1 | 1/2018 | Taras et al. |
| 2018/0128506 | A1 | 5/2018 | Taras et al. |
| 2018/0313555 | A1 | 11/2018 | Henderson |
| 2019/0032981 | A1 | 1/2019 | Hammond et al. |
| 2019/0178509 | A1 | 6/2019 | Taras et al. |
| 2020/0072510 | A1 | 3/2020 | Brown |
| 2020/0378667 | A1 | 12/2020 | Hammond et al. |
| 2021/0018234 | A1 | 1/2021 | Lingrey et al. |
| 2021/0095872 | A1 | 4/2021 | Taras et al. |
| 2021/0180807 | A1 | 6/2021 | Taras et al. |

FOREIGN PATENT DOCUMENTS

| | | | |
|---|---|---|---|
| CN | 201944952 | U | 8/2011 |
| CN | 102353126 | A | 2/2012 |
| CN | 203231582 | U | 10/2013 |
| CN | 103471275 | A | 12/2013 |
| CN | 203396155 | U | 1/2014 |
| CN | 203432025 | U | 2/2014 |
| EP | 134015 | | 3/1985 |
| EP | 1983275 | A1 | 10/2008 |
| JP | 2000046417 | | 2/2000 |
| JP | 2000274786 | | 10/2000 |
| JP | 2000314563 | | 11/2000 |
| JP | 2001248931 | | 9/2001 |
| KR | 100963221 | B1 | 6/2010 |
| WO | 9600370 | | 1/1996 |
| WO | 2001/90663 | | 11/2001 |
| WO | 2006/033782 | | 3/2006 |
| WO | 2008/045086 | | 4/2008 |
| WO | 2008/048252 | | 4/2008 |
| WO | 2010/005918 | | 1/2010 |
| WO | 2010/054498 | | 5/2010 |
| WO | 2010/104709 | | 9/2010 |
| WO | 2013/142760 | | 9/2013 |

(56) References Cited

FOREIGN PATENT DOCUMENTS

| | | | |
|---|---|---|---|
| WO | 2014/031559 | A1 | 2/2014 |
| WO | 2014/031708 | A1 | 2/2014 |

OTHER PUBLICATIONS

"Economized Vapor Injection (EVI) Compressors," Emerson Climate Technologies Application Engineering Bulletin AE4-1327 R2, Revised Sep. 2006 (9 pages).
"Enhanced Vapour Injection (EVI) forZH*KVE Scroll Compressors," Emerson Climate Technologies—Technical Information, C7.4.3/1107-0512/E, May 2012 (10 pages).
"Heat Pump Mechanics" http://www.geo4va.vt.edu/A3/A3.htm#A3sec3c (Accessed Apr. 20, 2011) (19 pages).
"Heat pumps in residential and commercial buildings" http://www.heatpumpcentre.org/en/aboutheatpumps/heatpumpsinresidential/Sidor/default.aspx (Accessed Apr. 20, 2011) (2 pages).
B.P. Rasmussen et al., "Model-Driven System Identification of Transcritical Vapor Compression Systems," IEEE Transactions on Control Systems Technology, May 2005, pp. 444-451, vol. 13 (8 pages).
Ekaterina Vi Nogradova, "Economizers in Chiller Systems," Bachelor's Thesis, Mikkelin Ammattikorkeakoulu, Nov. 2012 (50 pages).
Haraldsson et al., "Measurement of Performance and Evaluation of a Heat Pump—with Scroll Compressor EVI and Economizer," Lunds Institute of Technology, 2006 (4 pages).
Honeywell, VFF1, VFF2, VFF3, VFF6 Resilient Seat Butterfly Valves with Flanged Connections Jan. 2013, p. 1, 1st column, last paragraph. (Year: 2013) (20 pages).
International Preliminary Report on Patentability issued in International Application No. PCT/US2013/033433 dated Sep. 23, 2014 (7 Pages).
International Search Report and Written Opinion issued in International Application No. PCT/US2013/033433 dated Aug. 9, 2013 (11 Pages).
John P. Elson et al., "Scroll Technology: An Overview of Past, Present and Future Developments," International Compressor Engineering Conference, 2008, Paper 1871 (9 pages).
Korean Intellectual Property Office, International Search Report in International Application No. PCT/US2009/049734 (dated Jan. 20, 2010) (2 pages).
Korean Intellectual Property Office, International Search Report in International Application No. PCT/US2010/026010 (dated Sep. 28, 2010) (2 pages).
Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).
Michael F. Taras, "Reheat Which Concept is Best," ASHRAE Journal: 35-40 (Dec. 2004) (7 pages).
Murphy et al., "Air-Source Integrated Heat Pump for Net-Zero-Energy Houses Technology Status Report," *Oak Ridge National Laboratory*, ORNL-TM-2007-112 (Jul. 2007) (93 pages).
Murphy et al., "Ground-Source Integrated Heat Pump for Net-Zero-Energy Houses Technology Status Report," *Oak Ridge National Laboratory*, ORNL-TM-2007-177 (Dec. 2007) (78 pages).
Third Party Submission dated Nov. 10, 2014 filed in U.S. Appl. No. 13/848,342 (13 Pages).
Tolga N. Aynur, "Variable Refrigerant Flow Systems: A Review, Energy and Buildings," Jan. 2010, pp. 1106-1112, vol. 42 (7 pages).
Wei Yang et al., "The Design Method of U-Bend Geothermal Heat Exchanger of DX-GCHP in Cooling Model," IEEE, 2011, pp. 3635-3637 (English Abstract) (3 pages).

HEAT PUMP AND WATER HEATER

CROSS-REFERENCE TO RELATED APPLICATIONS

This application is a continuation of U.S. Nonprovisional application Ser. No. 15/634,434, filed on Jun. 27, 2017, which claims the benefit of U.S. Provisional Application No. 62/359,798 filed on Jul. 8, 2016. These applications are incorporated by reference herein in their entirety.

STATEMENT REGARDING FEDERALLY SPONSORED RESEARCH AND DEVELOPMENT

This application is not federally sponsored.

FIELD

The instant disclosure relates generally to heating, ventilation, and air conditioning systems and methods and, more particularly but without limitation, to heat pump systems and control methods.

BACKGROUND

Modern reversible heat pump systems are designed with improved efficiency and reduced energy consumption to comply with the heating, air conditioning, and ventilation industry trends, sustainability initiatives, and governmental regulations to increase efficiency thresholds in both heating and cooling modes of operation. In particular, integration of the water heating option into the heat pump design in commercial and residential applications (in place of electric or gas heaters) is becoming increasingly popular and allows for more efficient energy utilization to reduce an overall building waste heat disposal. However, due to limitations imposed by the system design and operating conditions, the cycle schematics that integrate the water heating option known to date are relatively costly, complex, inflexible in operation, and less reliable. They also employ extra refrigerant charge and often lack desirable control options and features. There exists a need, therefore, to solve these problems.

SUMMARY

A heat pump and water heating system for conditioning a space and heating water is disclosed, comprising: (a) a heat pump refrigerant circuit comprising a refrigerant circuit that fluidly interconnects: (i) a compressor having a discharge outlet and a suction port; (ii) a source heat exchanger; (iii) a space heat exchanger; (iv) an expansion valve positioned between the space heat exchanger and the source heat exchanger; (v) a reversing valve positioned on the discharge side of the compressor and configured to alternately direct refrigerant flow from the discharge outlet of the compressor to the one of the source heat exchanger and the space heat exchanger and to alternately return flow from the other of the source heat exchanger and the space heat exchanger to the suction port of the compressor; (vi) a water heater heat exchanger positioned on the discharge side of the compressor between the compressor and the reversing valve; (vii) a water heating valve on the discharge side of the compressor; (viii) a water heater heat exchanger bypass line connecting the water heating valve and the refrigerant line between the water heater heat exchanger and the reversing valve and configured to alternately direct at least a portion of refrigerant from the discharge outlet of the compressor to one of the bypass line or the water heater heat exchanger; and (b) controls for operating the heat pump and water heating system in response to the space conditioning demands and the water heating demands.

The water heating valve may be a regulating valve and the system controls may operate the regulating valve in response to the water heating demands to adjust the relative amount of refrigerant flow directed through the water heater heat exchanger and the water heater heat exchanger bypass line. The water heating valve may be a rapid cycle valve and the system controls may operate the rapid cycle valve in response to the water heating demands to adjust the relative amount of refrigerant flow directed through the water heater heat exchanger and the water heater heat exchanger bypass line. The water heating valve may be a pulse width modulation valve and the system controls may operate the pulse width modulation modulating valve in response to the water heating demands to adjust the relative amount of refrigerant flow directed through the water heater heat exchanger and the water heater heat exchanger bypass line.

The water heating valve may be a 3-way valve. The water heating valve may be a pair of conventional 2-way valves. The water heating valve may be positioned upstream the water heating heat exchanger with respect to the refrigerant flow. A check valve may be positioned downstream the water heating heat exchanger with respect to refrigerant flow. The water heating valve may be positioned downstream the water heating heat exchanger with respect to refrigerant flow.

The heat pump and water heating system may include a bypass circuit around the source heat exchanger, where the bypass circuit around the source heat exchanger may include a bypass refrigerant line and a bypass valve. The heat pump and water heating system may include a bypass circuit around the space heat exchanger, where the bypass circuit around the space heat exchanger may include a bypass refrigerant line and a bypass valve. The heat pump system may be one of water-to-air, water-to-water, air-to-water, and air-to-air system. The heat pump and water heating system may include air and water circulation devices assisting in heat interaction for space conditioning and water heating, where at least one of the compressor and the water circulating or air circulating devices may be a variable capacity device.

A method is disclosed for operating a heat pump system for conditioning a space and heating water wherein the heat pump system comprises a water heater heat exchanger, a water heater heat exchanger bypass line, and a water heater valve configured to direct refrigerant from the discharge side of the compressor in the heat pump system in selected relative percentages through the water heater heat exchanger and the water heater heat exchanger bypass line. The method includes operating the water heater valve in response to the space conditioning and water heating demands to adjust the selected relative percentages of refrigerant being directed through the water heater heat exchanger and the water heater heat exchanger bypass line.

The selected relative percentages of the refrigerant being directed through the water heater heat exchanger and the water heater heat exchanger bypass line may be in the range from zero percent to one hundred percent. The space conditioning demand may take a priority over water heating demand.

The water heating valve may be a regulating valve, and the method may include operating the regulating valve in response to the water heating demands of the space to adjust the relative amount of refrigerant flow directed through the water heater heat exchanger and the water heater heat exchanger bypass line. The water heating valve may be a rapid cycle valve, and the method may include operating the rapid cycle valve in response to the water heating demands of the space to adjust the relative amount of refrigerant flow directed through the water heater heat exchanger and the water heater heat exchanger bypass line. The water heating valve may be a pulse width modulation valve, and the method may include operating the pulse width modulation valve in response to the water heating demands of the space to adjust the relative amount of refrigerant flow directed through the water heater heat exchanger and the water heater heat exchanger bypass line. The water heating valve may be a 3-way valve. The water heating valve may be a pair of conventional 2-way valves.

The water heating valve may be positioned upstream of the water heating heat exchanger with respect to the refrigerant flow. The check valve may be positioned downstream of the water heating heat exchanger with respect to refrigerant flow. The water heating valve may be positioned downstream of the water heating heat exchanger with respect to refrigerant flow. The heat pump system may include a bypass circuit around the source heat exchanger and the bypass circuit around the source heat exchanger may include a bypass refrigerant line and a bypass valve. The heat pump system may include a bypass circuit around the space heat exchanger and the bypass circuit around the space heat exchanger may include a bypass refrigerant line and a bypass valve. The heat pump system may be one of water-to-air, water-to-water, air-to-water, and air-to-air system. The heat pump system may include air and water circulation devices assisting in heat interaction for space conditioning and water heating and the at least one of the compressor and the water circulating or air circulating devices may be a variable capacity device.

BRIEF DESCRIPTION OF THE DRAWINGS

The accompanying drawings, which are incorporated into and form a part of the specification, illustrate one or more embodiments and, together with this description, serve to explain the principles of the disclosure. The drawings merely illustrate various embodiments of the disclosure and are not to be construed as limiting the scope of the instant disclosure.

DETAILED DESCRIPTION OF THE PREFERRED EMBODIMENT(S)

The instant disclosure discloses a heat pump and water heater system having a simplified, reliable, flexible and inexpensive design that provides five distinct modes of operation that can be extended to numerous combinations thereof. In at least one embodiment, this is accomplished in principle by the addition of a water heating heat exchanger and a refrigerant bypass line around the water heating heat exchanger. A three-way valve allows the refrigerant flow through the bypass line to be actuated and controlled. The refrigerant circuit configurations in cooling and heating modes of operation for the conditioned space disclosed herein can integrate water heating with the space conditioning or employ water heating independently from the space conditioning. Furthermore, the system design is not susceptible to the refrigerant charge migration common in conventional systems. The system provides an advantage of requiring a lower refrigerant charge amount (which may be critical for the conversion to the low global warming refrigerants), provides enhanced efficiency in all modes of operation, and allows for an extended operational envelope.

Figure 1:
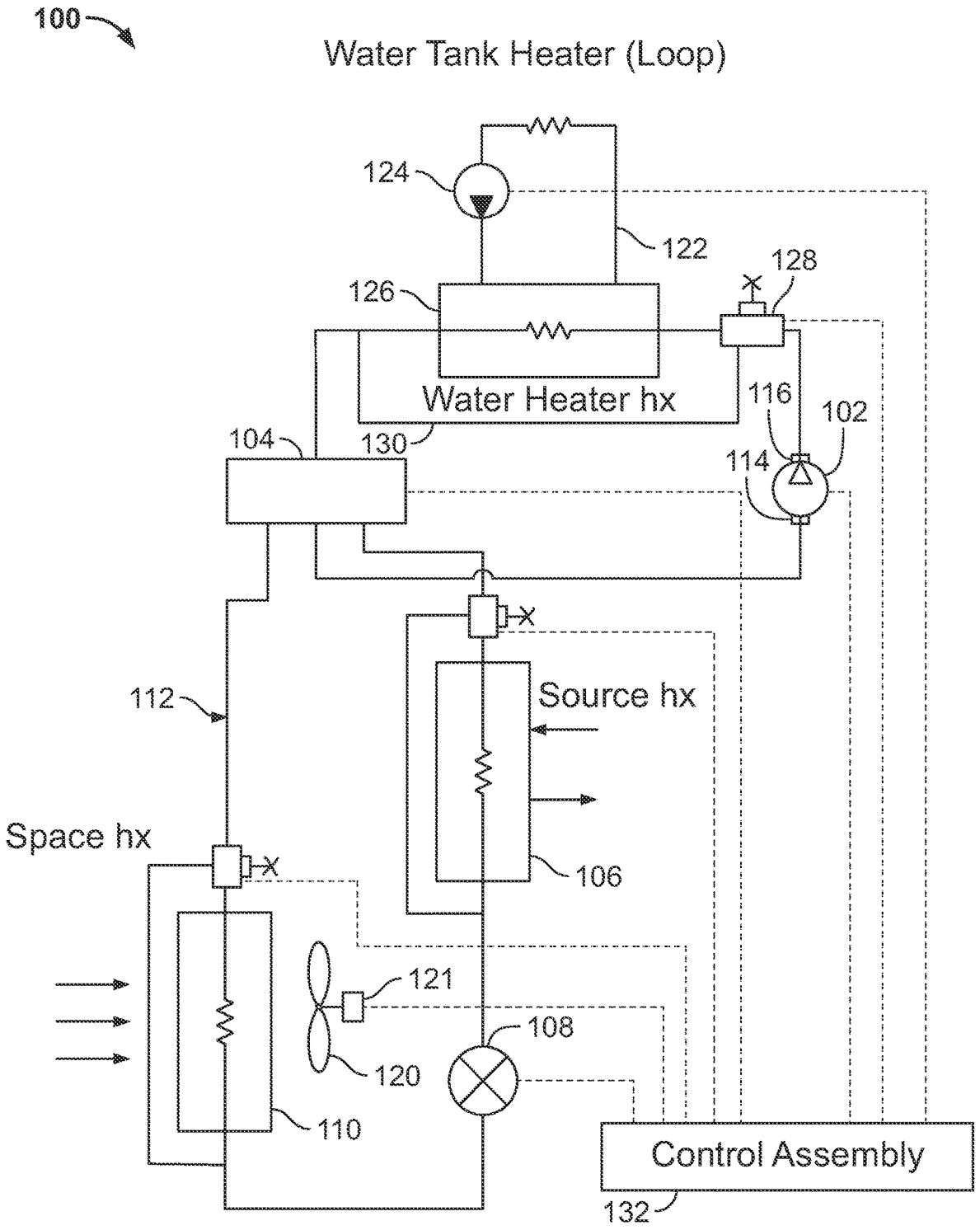
FIG. 1 is a schematic diagram of a heat pump and water heating system constructed in accordance with various embodiments of the instant disclosure.

Referring to FIG. 1, the heat pump system 100 comprises a compressor 102, a four-way reversing valve 104, a source heat exchanger 106, an expansion device 108, and a space heat exchanger 110, all interconnected by refrigerant lines designated collectively at 112. The compressor 102 has a suction inlet port 114 and discharge outlet port 116. The compressor 102 compresses refrigerant from a low pressure $P_1$ to a high pressure $P_2$ and circulates refrigerant throughout the refrigerant circuit.

The compressor 102 may be a variable capacity compressor, such as a variable speed compressor, a compressor with an integral pulse width modulation option, or a compressor incorporating various unloading options. These types of compressors allow for better control of the operating conditions and manage the thermal load on the heat pump system 100.

The source heat exchanger 106 may be a refrigerant-to-water, refrigerant-to-brine, or refrigerant-to-air heat exchanger and is not limited to any particular heat exchanger type or configuration. The associated fan or pump (not shown) may be of a variable flow type, such as being driven by a variable speed motor, a pulse width-modulated motor, or an ON/OFF cycling motor, to enhance operation and control of the heat pump system 100.

The expansion device 108 may be an electronic expansion valve, a mechanical expansion valve, or a fixed-orifice/capillary tube/accurator. The expansion device 108 may have bi-directional design or may be replaced by a pair of unidirectional expansion devices with the associated check valve bypass options to provide refrigerant re-routing when the flow changes direction throughout the refrigerant cycle.

The space heat exchanger 110 may be a refrigerant-to-air, refrigerant-to-water or refrigerant-to-brine heat exchanger and is not limited to any particular heat exchanger type or configuration. In the case of the exemplary air-to-refrigerant heat exchanger shown in the drawings, the associated air management system may be a fan 120 of any known type and may be equipped with a variable flow capability feature, such as being driven by a variable speed motor 121, to enhance operation and control of the heat pump system 100. Alternately, the motor 121 may be a pulse width modulated motor or an ON/OFF cycling motor. Of course, in the case of a water-to-refrigerant or brine-to-refrigerant heat exchanger, the fan 120 and motor 121 are replaced by a pump and a motor that may incorporate similar variable capacity capability.

The heat pump system 100 includes a water tank heater loop 122 for heating water in the structure (not shown). A pump 124 circulates water through the loop 122 and a water heater heat exchanger (WHHX) 126. The pump 124 may have a variable flow capability, such as being driven by a variable speed motor, pulse width modulated motor, or ON/OFF cycling motor, to better control operating conditions for the heat pump system 100 and water temperature within the water tank (not shown). The water heater heat exchanger 126, which is typically a refrigerant-to-water heat exchanger, is connected in-line between the discharge side of the compressor 102 and the 4-way reversing valve 104. The water heater heat exchanger 126 operates as a desuperheater and a condenser when it is engaged within the active refrigerant circuit of the heat pump system 100.

A 3-way valve 128 interposed between the compressor 102 and water heater heat exchanger 126 allows the system control 132 for the heat pump system 100 to command the operation of the loop 122. A bypass line 130 (WHHX bypass) connects the 3-way valve 128 to the outlet side of the water heater heat exchanger 126 to direct at least a portion of refrigerant around the water heater heat exchanger 126 when the water tank heater loop 122 is not actuated. In at least one embodiment, the 3-way valve 128 is a modulating type and can be controlled by a stepper motor (not shown) permitting the system control 132 for the heat pump system 100 modulate the percentage of the refrigerant flow directed through the bypass line 130 thus allowing for a better control of operating conditions for the heat pump system 100 and improved operation of the water heater heat exchanger 126.

Alternately, the 3-way valve 128 may be replaced by a pair of conventional valves, such as a pair of rapid cycle solenoid valves, or by a rapid cycle three-way valve. Furthermore, to prevent refrigerant migration while switching between different modes of operation, a check valve (not shown) may be positioned downstream the water heater heat exchanger 126 with respect to the refrigerant flow. Additionally, the 3-way valve 128 may be positioned at the exit of the water heater heat exchanger 126 with respect to the refrigerant flow.

The heat pump system 100 has five distinct modes of operation that are primarily controlled by the 4-way valve 104 and the 3-way valve 128, while augmented by the multiple variable capacity devices, such as compressors, fans and pumps, integrated into the system. These modes of operation are space cooling only, space cooling and water heating, space heating only, space heating and water heating, and water heating only. Additionally, the heat pump system 100 may adjust operation in any of the modes depicted above and exactly match the space conditioning and water heating requirements without excessive ON/OFF cycling that negatively impacts system reliability and fluctuations in operating conditions.

Figure 2:
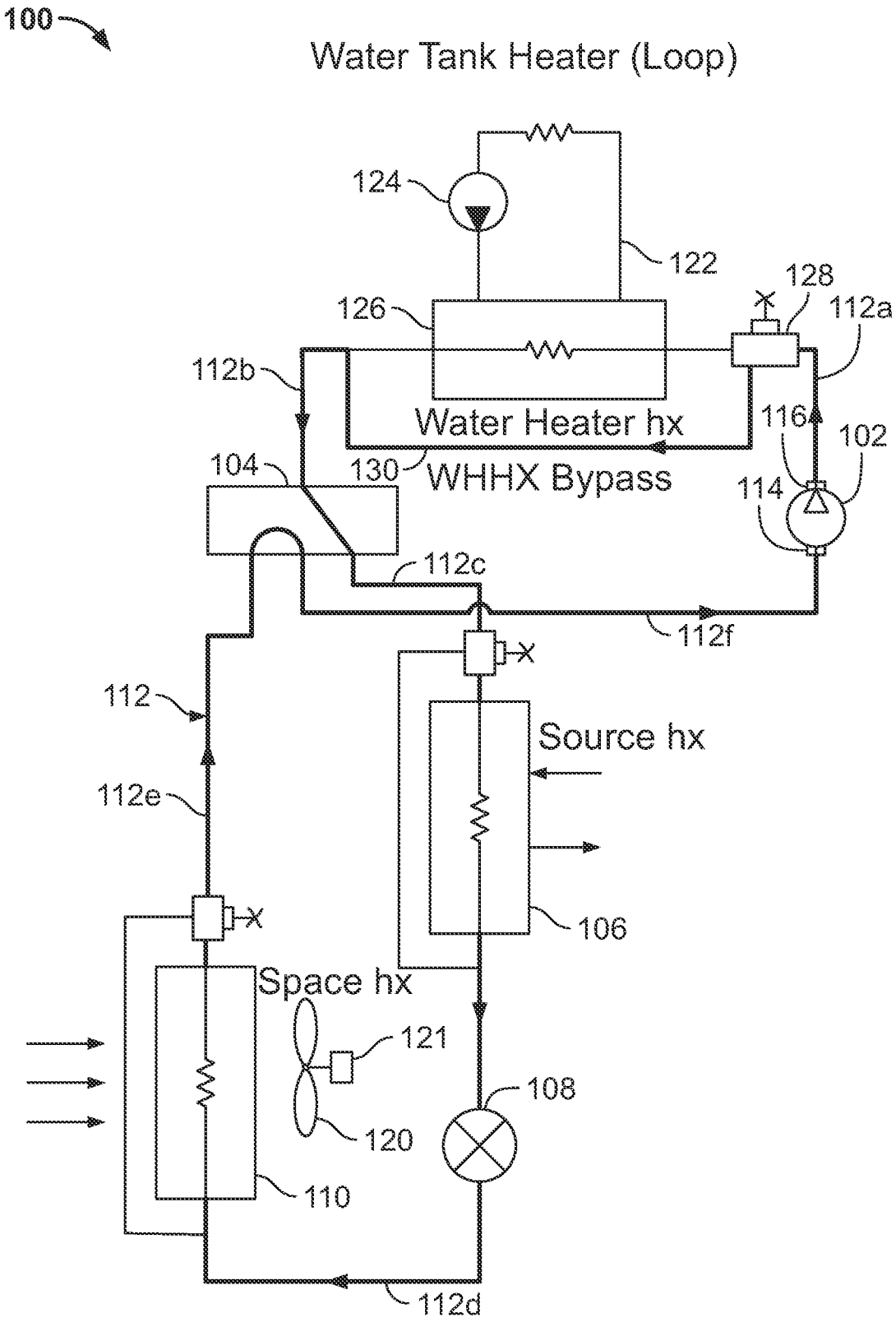
FIG. 2 is a schematic diagram of the heat pump and water heating circuit of FIG. 1 shown operating in a space cooling mode. The system controls are omitted to simplify the illustration.

In the space cooling mode of operation depicted in FIG. 2, the refrigerant is compressed in the compressor 102 and discharged from the compressor discharge port 116 into the discharge refrigerant line 112*a* connecting the compressor 102 to the 3-way valve 128. In the cooling mode of operation, the 3-way valve 128 directs the refrigerant flow through the bypass line 130 around the water heater heat exchanger 126 and refrigerant line 112*b* connecting the 3-way valve 120 and the 4-way valve 104.

The 4-way valve 104 is configured to connect the refrigerant to the source heat exchanger 106 through the refrigerant line 112*c*. In this mode, the source heat exchanger 106 is operating as a condenser to desuperheat, condense, and subcool the refrigerant and rejects heat from the refrigerant system to the environment (not shown).

Downstream the source heat exchanger 106, the refrigerant flows through the expansion device 108, where it is expanded from a high pressure to a lower pressure and its temperature is reduced. The refrigerant is then directed to the refrigerant line 112*d* and the space heat exchanger 110 that is acting as an evaporator and superheater in the cooling mode of operation, while removing heat and reducing humidity in the conditioned space (not shown). Downstream of the space heat exchanger 110, refrigerant line 112*e* connects the space heat exchanger 110 to the 4-way valve 104, which is configured to direct the refrigerant to the suction port 114 of the compressor 102 through the refrigerant line 112*f* to complete the refrigerant circuit.

Figure 3:
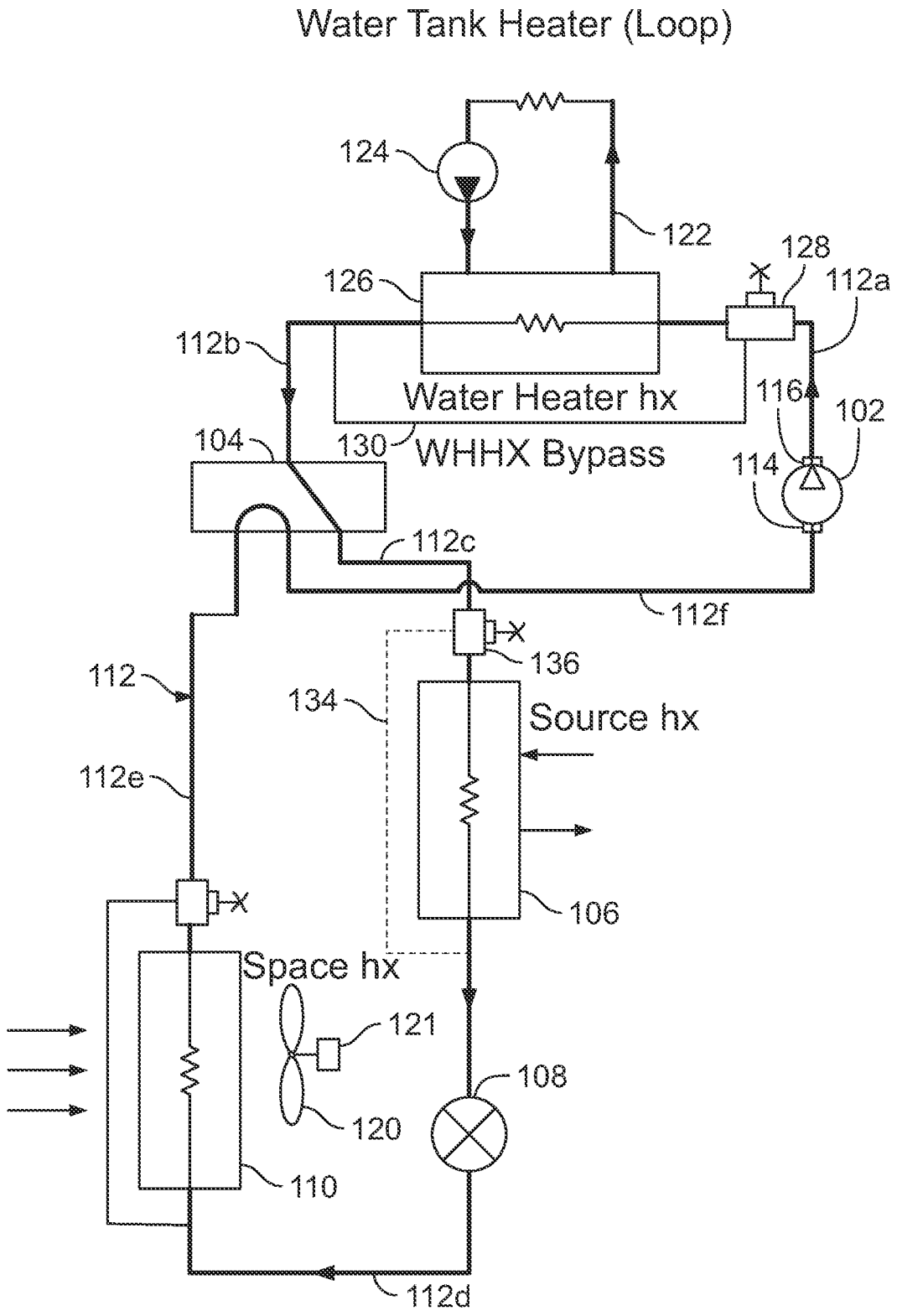
FIG. 3 is a schematic diagram of the heat pump and water heating circuit of FIG. 1 shown operating in a space cooling and water heating mode.
Figure 7:
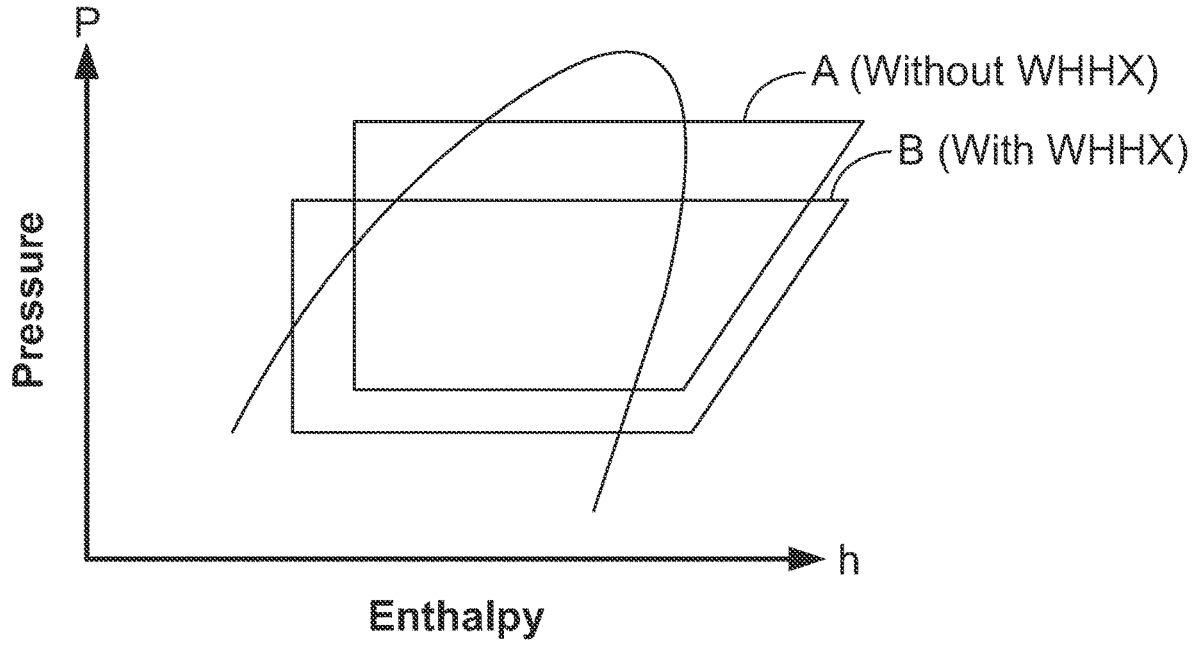
FIG. 7 shows the refrigerant cycles of the system of the present invention graphed onto a P-h (pressure-enthalpy) chart. The cycle designated as "A" illustrates the refrigerant cycle operating without the water heater heat exchanger (WHHX) and the cycle designated as "B" illustrates the refrigerant cycle operating with the water heater heat exchanger.

In the space cooling and water heating mode of operation depicted in FIG. 3, the 3-way valve 128 is configured to direct at least a portion of refrigerant through the water heater heat exchanger 126, instead of the bypass refrigerant line 130. In this mode of operation, the water heating heat exchanger 126 may operate as a desuperheater and partial condenser or, alternately, as a desuperheater, condenser, and subcooler. In the former case, the source heat exchanger 106 is used to complete the condensation process and subcool the refrigerant. In the latter case, the source heat exchanger 106 is used to further subcool the refrigerant and improve operational efficiency and dehumidification capability of the heat pump system 100 (see FIG. 7). Alternatively, in the latter case, the source heat exchanger 106 may be bypassed through a bypass line 134 using a 3-way valve 136 (as shown in broken lines) and the water supply for the source heat exchanger 106 may be shut down to reduce input power for the circulating pump (not shown). The 3-way valve 136 may have a variable capability feature and may be utilized as an auxiliary performance control and pressure control device. In all other aspects, this mode of operation is similar to the cooling mode of operation of FIG. 2.

It will be understood that, if the 3-way valve 128 has regulating (modulating) capability, the refrigerant flow between the bypass refrigerant line 130 and the water heating heat exchanger 126 can be adjusted in any proportion from zero to one hundred percent (0%-100%), precisely satisfying the water heating demand typically defined and measured by the temperature transducer integrated into the water tank, reducing a number of ON/OFF cycles, and thus improving system efficiency and reliability. Such flexibility of the 3-way modulating valve 128 may be combined with other variable capacity devices of the heat pump system 100 described above.

Figure 4:
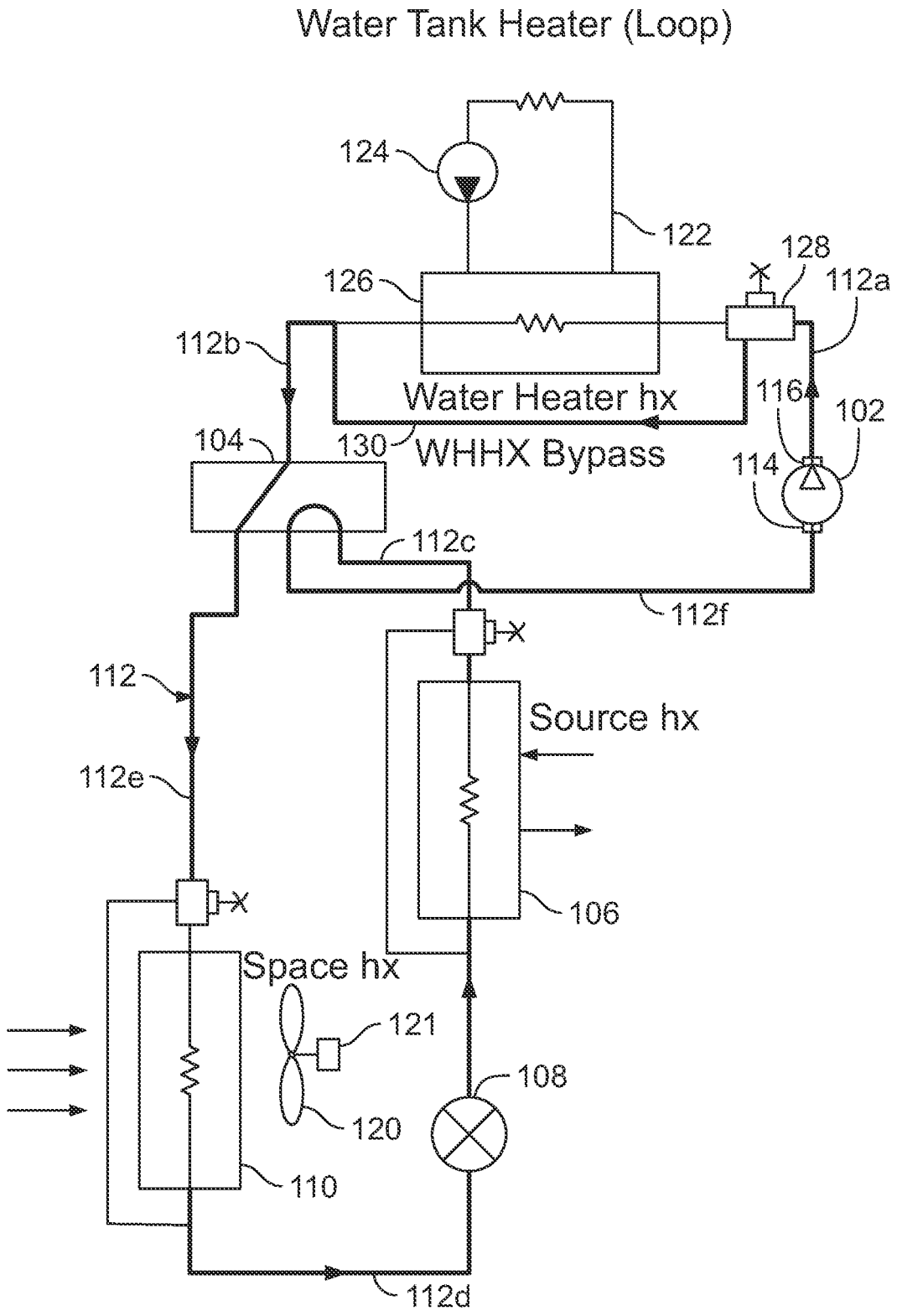
FIG. 4 is a schematic diagram of the heat pump and water heating circuit of FIG. 1 shown operating in a space heating mode.

In the space heating mode of operation depicted in FIG. 4, the refrigerant is compressed in the compressor 102 and discharged from the compressor discharge port 116 into the discharge refrigerant line 112*a* connecting the compressor 102 to the 3-way valve 128. In the heating mode of operation, the 3-way valve 128 directs the refrigerant flow through the bypass line 130 around the water heater heat exchanger 126 and refrigerant line 112*b* connecting the 3-way valve and the 4-way valve 104. The 4-way valve 104 is configured to direct the refrigerant through the refrigerant line 112*e* to the space heat exchanger 110, which in this mode operates as a condenser to desuperheat, condense, and subcool the refrigerant while heating the conditioned space (not shown). Downstream of the space heat exchanger 110, the refrigerant is directed through the refrigerant line 112*d* to the expansion device 108 where it is expanded from a high pressure to a lower pressure while its temperature is reduced. The refrigerant is then passed through the source heat exchanger 106 acting as an evaporator and superheater, in the heating mode of operation. Downstream of the source heat exchanger 106, the 4-way valve 104 is configured to direct the refrigerant through the refrigerant line 112*f* to the suction port 114 of the compressor 102 to complete the refrigerant cycle.

Figure 5:
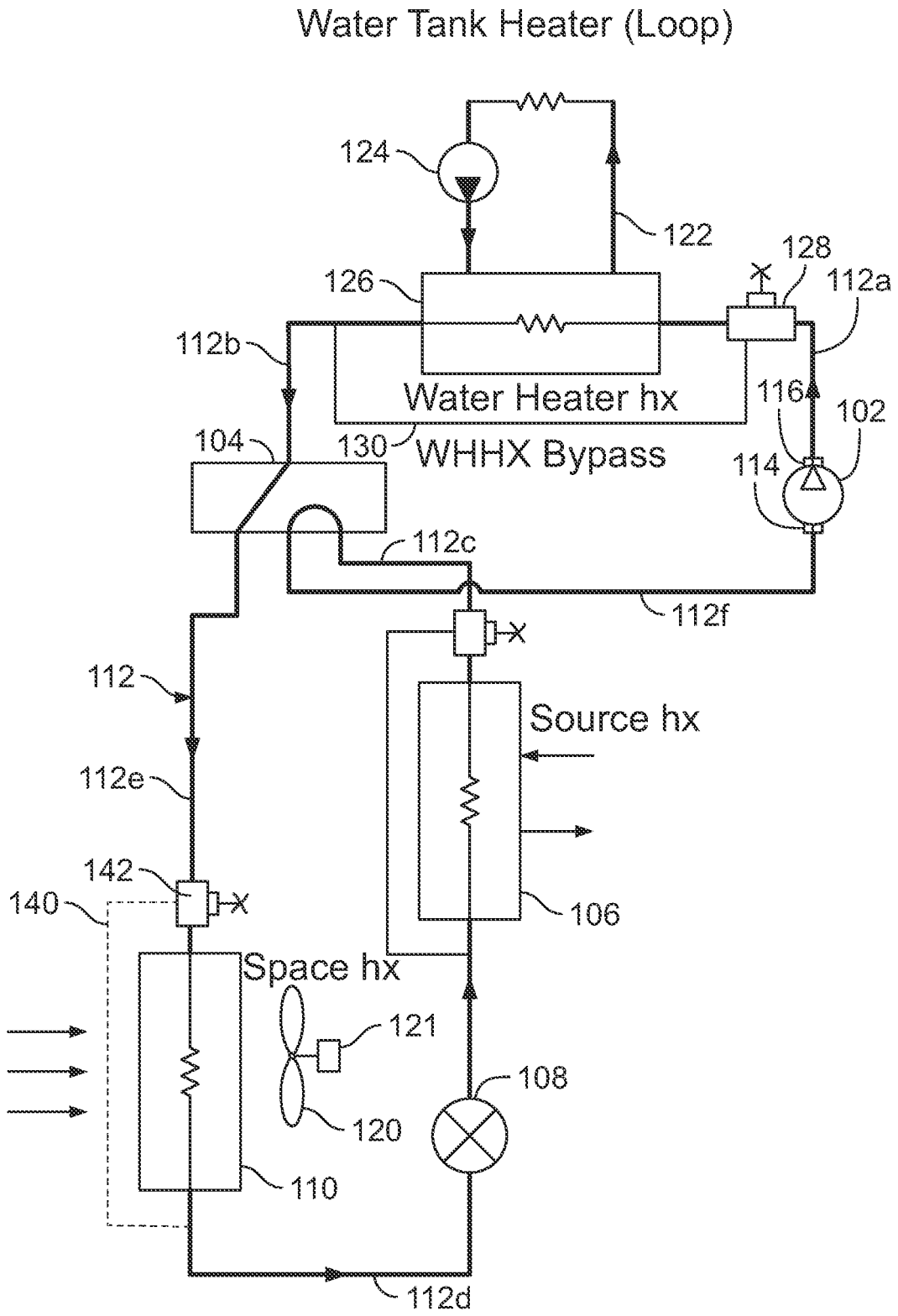
FIG. 5 is a schematic diagram of the heat pump and water heating circuit of FIG. 1 shown operating in a space heating and water heating mode.

In the space heating and water heating mode of operation depicted in FIG. 5, the 3-way valve 128 is configured to direct at least a portion of refrigerant through the water heater heat exchanger 126, instead of the bypass refrigerant line 130. In this mode of operation, the water heating heat exchanger 126 may operate as a desuperheater and partial condenser or, alternately, as a desuperheater, condenser, and subcooler. In the former case, the space heat exchanger 110 may be used to complete the condensation process and subcool the refrigerant. In the latter case, the space heat exchanger 110 may be used to further subcool the refrigerant to improve operational efficiency of the heat pump system 100 (see FIG. 7). Alternatively, in the latter case, at least a portion of refrigerant flow may bypass the space heat exchanger 110 through bypass line 140 using a 3-way valve 142 (as shown in broken lines in FIG. 6) and the airflow for the source heat exchanger 106 may be adjusted to reduce input power for the for the circulating fan (not shown). The 3-way valve 142 may have a variable capability feature and may be utilized as an auxiliary performance control and pressure control device. In all other aspects, this mode of operation is similar to the heating mode of operation depicted in FIG. 4.

It will be understood that the space heating requirements take the priority over the water heating and that water heating may be supplemented, if required, with a gas or electric heater (not shown). Furthermore, if the 3-way valve 128 has regulating (modulating) capability, the refrigerant flow between the bypass refrigerant line 130 and the water heating heat exchanger 126 can be adjusted in any proportion from zero to one hundred percent (0%-100%) precisely satisfying the water heating demand typically defined and measured by the temperature transducer integrated into the water tank, reducing a number of ON/OFF cycles, and thus improving system efficiency and reliability. Such flexibility of the 3-way modulating valve 128 may be combined with other variable capacity devices of the heat pump system 100 described above.

Figure 6:
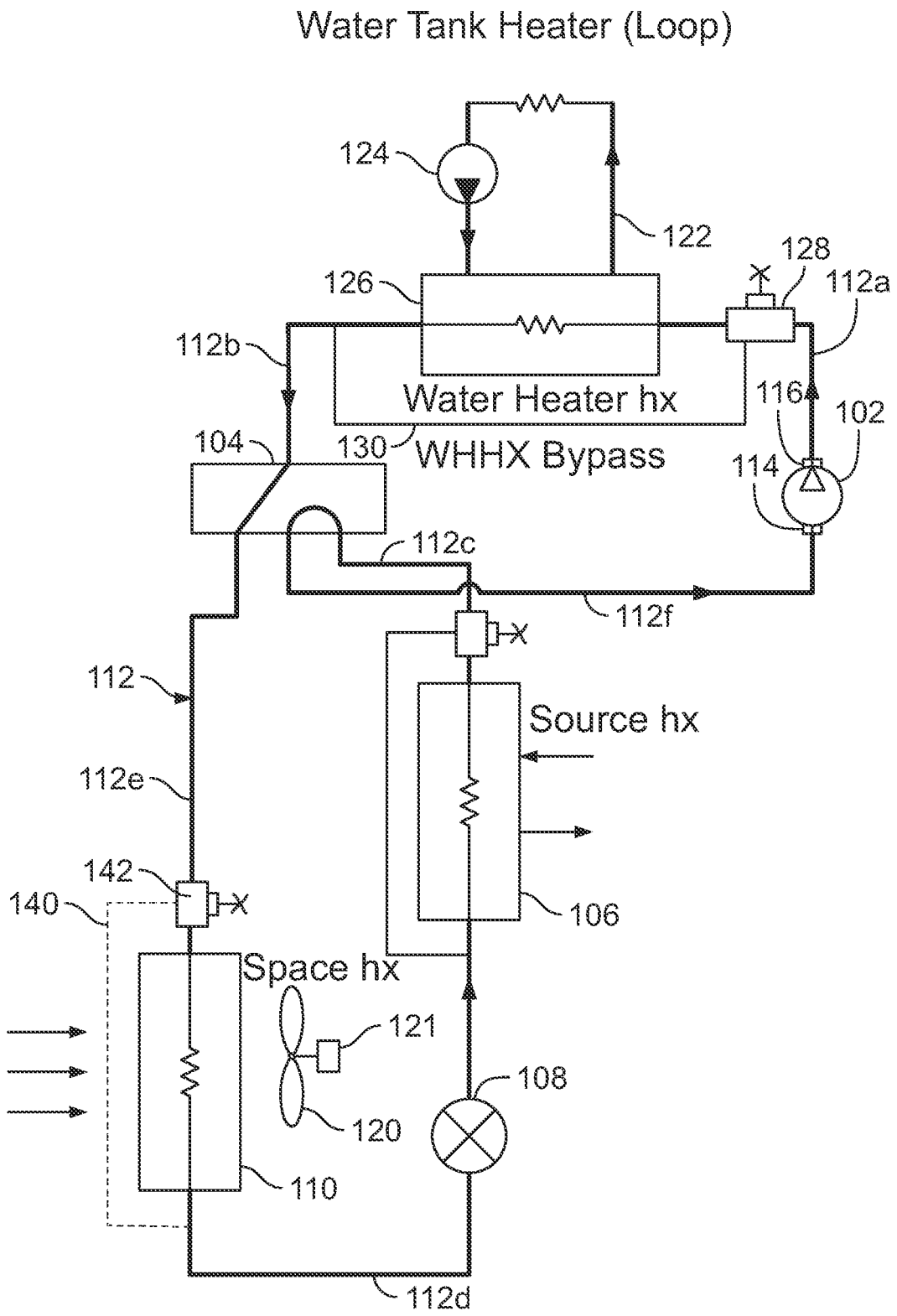
FIG. 6 is a schematic diagram of the heat pump and water heating circuit of FIG. 1 shown operating in a water heating mode.

In the water heating only mode of operation depicted in FIG. 6, the 3-way valve 128 is configured to direct the refrigerant through the water heater heat exchanger 126, instead of the bypass refrigerant line 130. In this mode of operation, the water heating heat exchanger 126 operates as a desuperheater, condenser, and subcooler. In this mode of operation, the airflow or water flow through the space heat exchanger 110 is deactivated. Alternatively, the space heat exchanger 110 may be bypassed through the bypass line 140 using the 3-way valve 142 to reduce the refrigerant side parasitic pressure drop. In all other aspects, this mode of operation is similar to the space heating and water heating mode of operation shown in FIG. 5.

Returning now to FIG. 1, the heat pump system 100 includes the controls 132 operatively connected to the electronic expansion device 108, the fan motor 121 controlling the speed and operation of the fan 120, the 4-way reversing valve 104, the variable speed compressor 102, the three-way valve 128, and the pump motor controlling the speed and operation of the pump 124 in the water heater loop 122. The system controls 132 for the heat pump system 100 will also include various sensors (not shown), such as temperature sensors to report the air temperature in the space, the water temperature of the water in the water tank loop, and temperatures, pressures, flow rates and speed of the various components driven by electric motors, throughout the heat pump system 100.

The control logic will be programmed to selectively operate the water heater heat exchanger loop or/and to at least partially bypass it using the three-way valve 128. The control logic preferably is set up to allow for the space conditioning as the higher priority over water heating. The refrigerant head pressure control, to ensure safe and reliable operation of the system components such as the 4-way reversing valve 104 and compressor 102, can be accomplished by adjusting the compressor speed, fan speed, pump speed, and the amount of refrigerant flowing through the water heater heat exchanger bypass refrigerant lines 130, 134 and 140.

The selective utilization of the water heating heat exchanger 126, in combination with the space heat exchanger 110 or the source heat exchanger 106 and air/water moving devices, such as the fan 120 and the water heater heat exchanger loop pump 124, respectively in the heating and cooling mode of operation, allows for the system performance (capacity and efficiency) optimization and dehumidification capability improvement.

As described above, the heat pump system 100 of the present disclosure offers many advantages and benefits. By way of example, as depicted above and illustrated in the P-h diagram of FIG. 7, when the water heater heat exchanger is included in the active operating circuit of the heat pump system 100, the system efficiency is enhanced, compressor power is reduced, and dehumidification capability is improved. The system provides augmented performance and control as well as offers reduced cost, improved operational flexibility, and enhanced reliability.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present disclosure have been described in the drawings and accompanying text, the description is illustrative only. Changes may be made in the details, especially in matters of shape, size, and arrangement of the parts within the principles of the instant disclosure to the full extent indicated by the broad meaning of the terms of the attached claims. The description and drawings of the specific embodiments herein do not point out what an infringement of this patent would be, but rather provide an example of how to use and make the invention as defined by the appended claims. Likewise, the abstract is neither intended to define the invention, which is measured by the appended claims, nor is it intended to be limiting as to the scope of the instant disclosure in any way. Rather, the limits of the invention and the bounds of patent protection are measured by and defined in the following claims.

What is claimed is:

1. A heat pump system for conditioning air in a space, comprising:

a variable speed compressor configured to circulate a refrigerant through a refrigerant circuit, the variable speed compressor having a discharge outlet port and an inlet suction port;

a refrigerant-to-liquid heat exchanger configured to exchange heat between the refrigerant and a heat exchange liquid;

a refrigerant-to-air heat exchanger configured to exchange heat between the refrigerant and the air, the air conditioned thereby for use in the space;

a bi-directional expansion valve disposed on the refrigerant circuit and positioned between the refrigerant-to-liquid heat exchanger and the refrigerant-to-air heat exchanger;

a desuperheater heat exchanger configured to exchange heat between the refrigerant and water to heat the water;

a 3-way valve disposed along the refrigerant circuit between the variable speed compressor and the desuperheater heat exchanger, wherein the 3-way valve is connected to a desuperheater bypass circuit to permit the refrigerant to bypass the desuperheater heat exchanger, wherein the 3-way valve is configured to selectively direct the refrigerant from the variable speed compressor to either the desuperheater heat exchanger or the desuperheater bypass circuit;

a reversing valve disposed along the refrigerant circuit, the reversing valve including a first port configured to receive the refrigerant from the desuperheater bypass circuit and/or from the desuperheater heat exchanger, a second port connected to the inlet suction port of the variable speed compressor, a third port connected to the refrigerant-to-air heat exchanger, and a fourth port connected to the refrigerant-to-liquid heat exchanger, wherein in a first operating mode the reversing valve is configured to convey the refrigerant from the first port to the fourth port and from the second port to the third port to cause the refrigerant to flow to the refrigerant-to-liquid heat exchanger configured to operate as a condenser, through the bi-directional expansion valve, and to the refrigerant-to-air heat exchanger configured to operate as an evaporator, and wherein in a second operating mode the reversing valve is configured to convey the refrigerant from the first port to the third port and from the second port to the fourth port to cause the refrigerant to flow to the refrigerant-to-air heat exchanger configured to operate as a condenser, through the bi-directional expansion valve, and to the refrigerant-to-liquid heat exchanger configured to operate as an evaporator.

2. The heat pump system of claim 1, including a fan driven by a variable speed motor, the fan configured to flow air over a portion of the refrigerant-to-air heat exchanger.

3. The heat pump system of claim 1, wherein the bi-directional expansion valve is a fixed orifice valve, a mechanical valve, or an electronic valve.

4. The heat pump system of claim 1, wherein the desuperheater heat exchanger is a second refrigerant-to-liquid heat exchanger configured to exchange heat between the refrigerant in the refrigerant circuit and the water in a water storage loop.

5. The heat pump system of claim 4, including a variable speed water pump for circulating heated water in the water storage loop and through the desuperheater heat exchanger.

6. The heat pump system of claim 1, including a variable speed pump disposed on a source loop for circulating the heat exchange liquid through the refrigerant-to-liquid heat exchanger.

7. The heat pump system of claim 1, including a controller configured to control operation of the variable speed compressor, the reversing valve, the 3-way valve, the bi-directional expansion valve, a first variable speed pump for circulating the water through the desuperheater heat exchanger, and a second variable speed pump for circulating the heat exchange liquid through the refrigerant-to-liquid heat exchanger.

8. The heat pump system of claim 1, wherein the reversing valve and the 3-way valve are configured to alter the flow of the refrigerant to change a mode of operation between the first operating mode defining a space cooling mode, a space cooling and water heating mode, the second operating mode defining a space heating mode, a space heating and water heating mode, and a primary water heating mode.

9. The heat pump system of claim 8, including a second 3-way valve connected to a refrigerant-to-liquid heat exchanger bypass circuit to permit the refrigerant to bypass the refrigerant-to-liquid heat exchanger in the space cooling and water heating mode.

10. The heat pump system of claim 9, including a third 3-way valve connected to a refrigerant-to-air heat exchanger bypass circuit to permit the refrigerant to bypass the refrigerant-to-air heat exchanger in the space heating and water heating mode and in the water heating mode.

11. The heat pump system of claim 8, wherein to operate in the space cooling mode, the 3-way valve is configured to direct the refrigerant from the variable speed compressor to the reversing valve via the desuperheater bypass circuit;

the reversing valve is configured to direct the refrigerant, via the first port and the fourth port, to the refrigerant-to-liquid heat exchanger that is configured to operate as a condenser, the bi-directional expansion valve is configured to receive the refrigerant from the refrigerant-to-liquid heat exchanger, the refrigerant-to-air heat exchanger is configured as an evaporator and receive the refrigerant from the bi-directional expansion valve, and the reversing valve is configured to receive, via the third port, the refrigerant from the refrigerant-to-air heat exchanger and direct, via the second port, the refrigerant to the variable speed compressor.

12. The heat pump system of claim 8, wherein to operate in the space cooling and water heating mode, the 3-way valve is configured to direct the refrigerant from the variable speed compressor to the desuperheater heat exchanger, the reversing valve is configured to receive, via the first port, the refrigerant from the desuperheater heat exchanger and direct, via the fourth port, the refrigerant to the refrigerant-to-liquid heat exchanger that is configured to operate as a condenser, the bi-directional expansion valve is configured to receive the refrigerant from the refrigerant-to-liquid heat exchanger, the refrigerant-to-air heat exchanger is configured to operate as an evaporator and receive the refrigerant from the bi-directional expansion valve, and the reversing valve is configured to receive, via the third port, the refrigerant from the refrigerant-to-air heat exchanger and direct, via the second port, the refrigerant to the variable speed compressor.

13. The heat pump system of claim 8, wherein to operate in the space heating mode, the 3-way valve is configured to direct the refrigerant from the variable speed compressor to the reversing valve via the desuperheater bypass circuit;

the reversing valve is configured to direct the refrigerant, via the first port and the third port, to the refrigerant-to-air heat exchanger that is configured to operate as a condenser, the bi-directional expansion valve is configured to receive the refrigerant from the refrigerant-to-air heat exchanger, the refrigerant-to-liquid heat exchanger is configured to operate as an evaporator and receive the refrigerant from the bi-directional expansion valve, and the reversing valve is configured to receive, via the fourth port, the refrigerant from the refrigerant-to-liquid heat exchanger and direct, via the second port, the refrigerant to the variable speed compressor.

14. The heat pump system of claim 8, wherein to operate in the space heating and water heating mode, the 3-way valve is configured to direct the refrigerant from the variable speed compressor to the desuperheater heat exchanger, the reversing valve is configured to receive, via the first port, the refrigerant from the desuperheater heat exchanger and direct, via the third port, the refrigerant to the refrigerant-to-air heat exchanger that is configured to operate as a condenser, the bi-directional expansion valve is configured to receive the refrigerant from the refrigerant-to-air heat exchanger, the refrigerant-to-liquid heat exchanger is configured to operate as an evaporator and receive the refrigerant from the bi-directional expansion valve, the reversing valve is configured to receive, via the fourth port, the refrigerant from the refrigerant-to-liquid heat exchanger and direct, via the second port, the refrigerant to the variable speed compressor.

15. The heat pump system of claim 8, wherein to operate in the primary water heating mode, the 3-way valve is configured to direct the refrigerant from the variable speed compressor to the desuperheater heat exchanger that is configured to operate as a desuperheater, condenser, and subcooler, the reversing valve is configured to receive, via the first port, the refrigerant from the desuperheater heat exchanger and direct, via the third port, the refrigerant toward the refrigerant-to-air heat exchanger, the bi-directional expansion valve is configured to subsequently receive the refrigerant, the refrigerant-to-liquid heat exchanger is configured to operate as an evaporator and receive the refrigerant from the bi-directional expansion valve, and the reversing valve is configured to receive, via the fourth port, the refrigerant from the refrigerant-to-liquid heat exchanger and direct, via the second port, the refrigerant to the variable speed compressor.

* * * * *